US010077163B2

(12) United States Patent
Wada

(10) Patent No.: US 10,077,163 B2
(45) Date of Patent: Sep. 18, 2018

(54) STACKED SHEET DETECTION DEVICE, IMAGE FORMING APPARATUS

(71) Applicant: KYOCERA Document Solutions Inc., Osaka-shi, Osaka (JP)

(72) Inventor: Hiroshi Wada, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/713,356

(22) Filed: Sep. 22, 2017

(65) Prior Publication Data

US 2018/0088513 A1 Mar. 29, 2018

(51) Int. Cl.

| | |
|---|---|
| ***B65H 29/12*** | (2006.01) |
| ***B65H 43/02*** | (2006.01) |
| ***B65H 43/08*** | (2006.01) |
| ***B65H 43/06*** | (2006.01) |

(52) U.S. Cl.

CPC ..... *B65H 29/12* (2013.01); *B65H 29/125* (2013.01); *B65H 43/02* (2013.01); *B65H 43/06* (2013.01); *B65H 43/08* (2013.01); *B65H 2511/152* (2013.01); *B65H 2553/612* (2013.01)

(58) Field of Classification Search

CPC ..... B65H 43/02; B65H 43/06; B65H 43/08; B65H 29/12; B65H 29/125; B65H 29/00; B65H 31/00; B65H 2511/152; B65H 2553/612

USPC ..... 271/176, 215

See application file for complete search history.

(56) References Cited

U.S. PATENT DOCUMENTS

| | | | | |
|---|---|---|---|---|
| 3,968,364 | A * | 7/1976 | Miller | B65H 43/08 250/231.1 |
| 4,230,312 | A * | 10/1980 | Templeton | B65H 43/06 271/215 |
| 5,033,731 | A * | 7/1991 | Looney | B65H 43/06 271/176 |
| 2005/0035535 | A1* | 2/2005 | Ogata | B65H 31/02 271/220 |
| 2005/0035540 | A1* | 2/2005 | Carter | B65H 7/02 271/303 |
| 2009/0295083 | A1* | 12/2009 | Kitan | B65H 29/70 271/306 |

(Continued)

FOREIGN PATENT DOCUMENTS

JP 2007204228 A 8/2007

*Primary Examiner* — David H Bollinger

(74) *Attorney, Agent, or Firm* — Alleman Hall Creasman & Tuttle LLP

(57) ABSTRACT

A stacked sheet detection device includes a shaft, at least one first rotor, a second rotor, and a detection sensor. The shaft includes a plurality of attached portions that are formed in alignment along a width direction perpendicular to a discharge direction of sheets. The first rotor is attachable to any one of the plurality of attached portions. The first rotor includes a fitting portion and an arm portion. The fitting portion is configured to be fitted with one of the attached portions. The arm portion is formed to extend from the fitting portion toward the discharge tray and configured to abut on the sheets stacked on the discharge tray. The first rotor is selectively attachable to any one of the plurality of attached portions. The detection sensor is configured to detect that the second rotor rotates in the predetermined rotation direction beyond a predetermined first detection position.

10 Claims, 8 Drawing Sheets

(56) References Cited

U.S. PATENT DOCUMENTS

| | | | | |
|---|---|---|---|---|
| 2014/0151957 | A1* | 6/2014 | Ono | B65H 31/02<br>271/207 |
| 2015/0248098 | A1* | 9/2015 | Izumichi | G03G 15/6529<br>271/314 |
| 2015/0307311 | A1* | 10/2015 | Ono | B65H 31/02<br>271/176 |
| 2016/0271932 | A1* | 9/2016 | Tanaka | B65H 31/02 |
| 2017/0101283 | A1* | 4/2017 | Tsuji | B65H 31/34 |

* cited by examiner

STACKED SHEET DETECTION DEVICE, IMAGE FORMING APPARATUS

INCORPORATION BY REFERENCE

This application is based upon and claims the benefit of priority from the corresponding Japanese Patent Application No. 2016-190753 filed on Sep. 29, 2016, the entire contents of which are incorporated herein by reference.

BACKGROUND

The present disclosure relates to a stacked sheet detection device and an image forming apparatus including the same.

In general, an image forming apparatus discharges a sheet with an image formed thereon from a discharge port of a main body portion to a discharge tray. In addition, the image forming apparatus may be provided with a stacked sheet detection device configured to detect that sheets are stacked on the discharge tray exceeding a predetermined allowable level.

The stacked sheet detection device may be called a fullness detection device, for example. The stacked sheet detection device includes a shaft, a first rotor, a second rotor, and a fullness detection sensor. The shaft is rotatably supported above the discharge port. The first and second rotors are provided on the shaft. The fullness detection sensor is configured to detect that the second rotor rotates beyond an allowable range. The first rotor is formed in a region of the shaft corresponding to the width of the discharge port so as to project from the shaft toward the discharge tray. The second rotor is provided in a region of the shaft outside the region corresponding to the width of the discharge port.

When the sheets stacked on the discharge tray exceed a certain level of height, the sheets push up the first rotor, and the fullness detection sensor detects that the second rotor has rotated beyond the allowable range.

In addition, the stacked sheet detection device may include a plurality of first rotors aligned at intervals along the width direction of the sheets. In this case, when the sheets stacked on the discharge tray push up at least one of the first rotors, the fullness detection sensor can detect a rotation of the second rotor. With this configuration, even when the orientation of the sheets stacked on the discharge tray is inclined with respect to the sheet discharge direction, any of the plurality of first rotors is pushed up by the sheets, and the fullness detection sensor can detect the fullness of the sheets on the discharge tray.

In addition, the load of the first rotor is applied to the sheet when the discharged sheet is on the way from the discharge port to the discharge tray. With this configuration, in a case where a sheet is discharged from the discharge port in a curled state, the first rotor restricts an excessive floating of the sheet, thereby preventing a stack failure of the sheets on the discharge tray.

SUMMARY

A stacked sheet detection device according to an aspect of the present disclosure detects sheets discharged from a discharge port of a sheet conveyance path and are stacked on the discharge tray exceeding an allowable level. The stacked sheet detection device includes a shaft, at least one first rotor, a second rotor, and a first detection sensor. The shaft is rotatably supported above the discharge port so as to extend in parallel with a width direction perpendicular to a discharge direction of the sheets. The first rotor is attached to the shaft so as to project toward the discharge tray, and configured to rotate in conjunction with the shaft in a predetermined rotation direction when pushed up by the sheets stacked on the discharge tray. The second rotor projects from the shaft radially and is configured to rotate integrally with the shaft. The first detection sensor is configured to detect that the second rotor has rotated in the predetermined rotation direction beyond a predetermined first detection position. The shaft includes a plurality of attached portions formed in alignment along the width direction and to which the first rotor is attachable. The first rotor includes a fitting portion and an arm portion. The fitting portion is fitted with one of the attached portions. The arm portion is formed to extend from the fitting portion toward the discharge tray and configured to abut on the sheets stacked on the discharge tray. The first rotor is selectively attachable to any one of the plurality of attached portions.

An image forming apparatus according to another aspect of the present disclosure includes an image forming portion, a sheet discharge portion, and the stacked-sheet detection device. The image forming portion forms an image on a sheet conveyed along a sheet conveyance path. The sheet discharge portion discharges the sheet with the image formed thereon from a discharge port of the sheet conveyance path onto a discharge tray.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

First Embodiment: Image Forming Apparatus 10

A stacked sheet detection device 5 according to a first embodiment is applied to an image forming apparatus 10. The image forming apparatus 10 shown in FIG. 1 forms an image on a sheet 9 by an electrophotographic system. The sheet 9 is a sheet-like image formation medium such as a sheet of paper, an envelope, or an OHP sheet.

Figure 1:
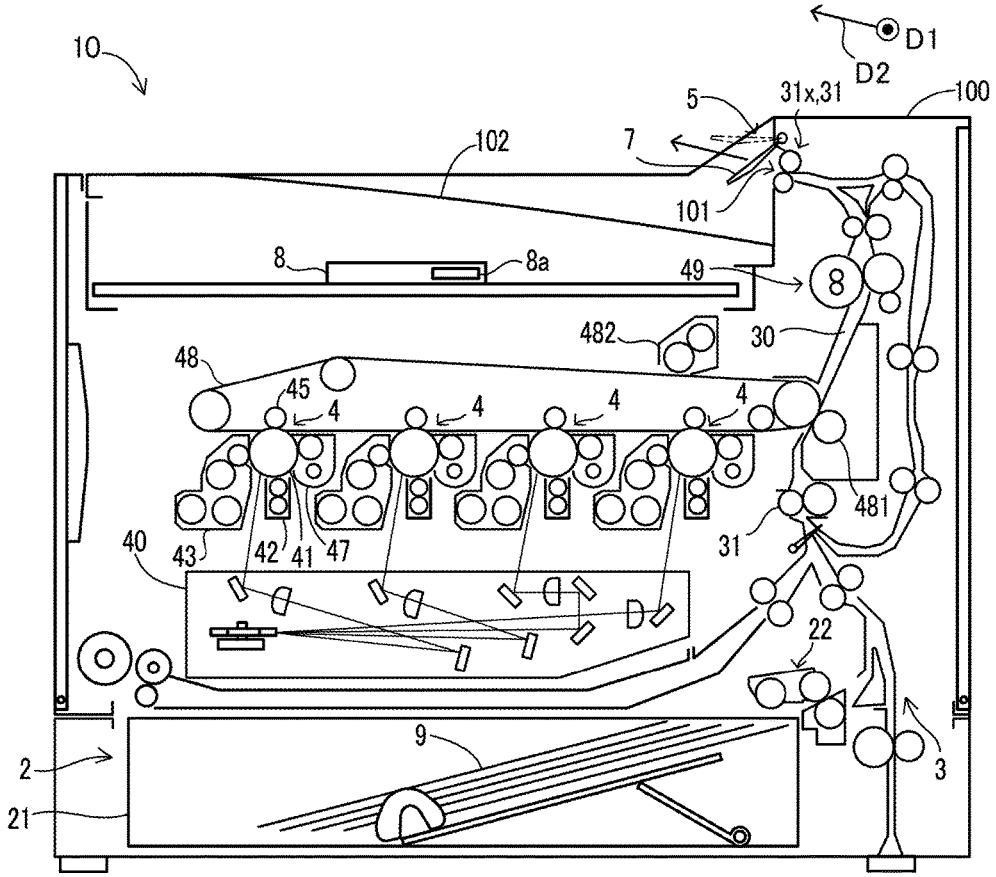
FIG. 1 is a configuration diagram of an image forming apparatus provided with a stacked sheet detection device according to a first embodiment of the present disclosure.

As shown in FIG. 1, the image forming apparatus 10 includes, in a main body portion 100, a sheet supply portion 2, a sheet conveying portion 3, an image creating portion 4, a laser scanning portion 40, a fixing device 49, a stacked sheet detection device 5, and a control portion 8.

The image forming apparatus 10 shown in FIG. 1 is a tandem-type image forming apparatus. As a result, the image forming apparatus 10 includes a plurality of image creating portions 4 that correspond to colors of cyan, magenta, yellow, and black, an intermediate transfer belt 48, a secondary transfer device 481, and a secondary cleaning device 482.

In the sheet supply portion 2, a sheet feed portion 22 feeds sheets 9 stored in a sheet cassette 21 one by one to a sheet conveyance path 30.

The sheet conveying portion 3 includes a plurality of pairs of conveyance rollers 31 that convey the sheet 9 along the sheet conveyance path 30. The plurality of pairs of conveyance rollers 31 include a pair of discharge rollers 31*x* that discharge the sheet 9 from a discharge port 101 onto a discharge tray 102. The pair of discharge rollers 31*x* are an example of the sheet discharge portion.

The discharge port 101 is an exit of the sheet conveyance path 30. The sheet 9 discharged from the discharge port 101 onto the discharge tray 102 has an image formed thereon, and is a print.

A width direction D1 of the discharge port 101 is a longitudinal direction of the discharge port 101, and is a horizontal direction perpendicular to a discharge direction D2 of the sheet 9. The width direction D1 also extends along rotation axes of the pair of discharge rollers 31*x*. In the present embodiment, the discharge direction D2 extends diagonally upward slightly with respect to the horizontal direction.

In each of the image creating portions 4, a drum-like photoconductor 41 rotates, and a charging device 42 charges the surface of the photoconductor 41 uniformly. Furthermore, the laser scanning portion 40 writes an electrostatic latent image on the surface of the photoconductor 41, and a developing device 43 develops the electrostatic latent image on the surface of the photoconductor 41 by toner. This allows a toner image to be formed on the surface of the photoconductor 41.

Furthermore, in each of the image creating portions 4, a primary transfer device 45 transfers the toner image from the surface of the photoconductor 41 to the intermediate transfer belt 48. Thus, on the intermediate transfer belt 48, a plurality of toner images are transferred from the plurality of photoconductors 41. This allows a color toner image to be formed on the intermediate transfer belt 48, with the toner images of a plurality of colors overlaid with each other. The cleaning portion 47 removes residual toner from the surface of the photoconductor 41.

The secondary transfer device 481 transfers, in the sheet conveyance path 30, the color toner image from the intermediate transfer belt 48 to the sheet 9. The secondary cleaning device 482 removes residual toner from the intermediate transfer belt 48.

The fixing device 49, in the sheet conveyance path 30, heats the toner image on the sheet 9, and fixes the toner image to the sheet 9.

The control portion 8 controls electric equipment provided in the image forming apparatus 10. For example, the control portion 8 is implemented by a processor that executes a program stored in a computer-readable nonvolatile storage portion 8*a*. The processor is an MPU (Micro Processor Unit), a DSP (Digital Signal Processor) or the like. The storage portion 8*a* is, for example, a ROM or a flash memory.

In the image forming apparatus 10, the laser scanning portion 40, the plurality of image creating portions 4, the intermediate transfer belt 48, the secondary transfer device 481, and the fixing device 49 constitute an example of the image forming portion that forms an image on the sheet 9 conveyed along the sheet conveyance path 30.

The stacked sheet detection device 5 is provided in a region that covers a front upper side and a front side of the discharge port 101. The stacked sheet detection device 5 is configured to detect that the sheets 9 discharged from the discharge port 101 and stacked on the discharge tray 102 have exceeded a predetermined allowable level.

[Outline of Stacked Sheet Detection Device 5]

Figure 2:
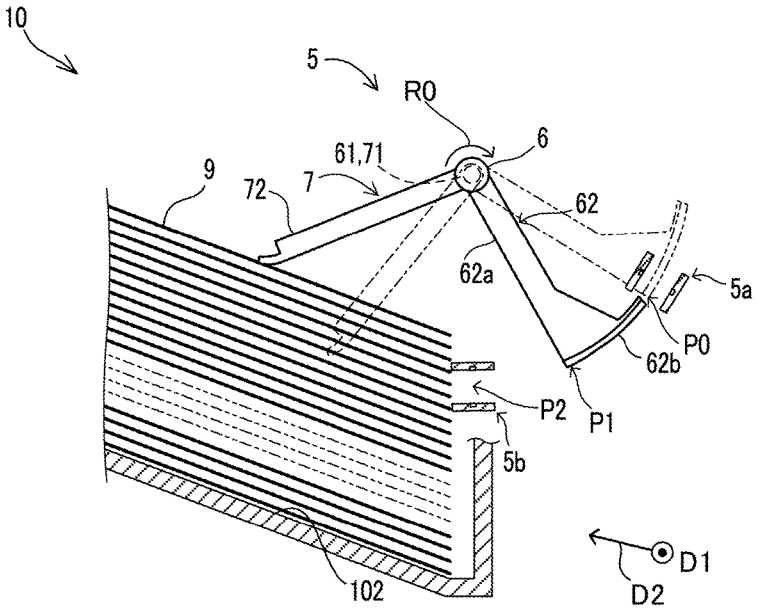
FIG. 2 is a side view of the stacked sheet detection device according to the first embodiment.
Figure 3:
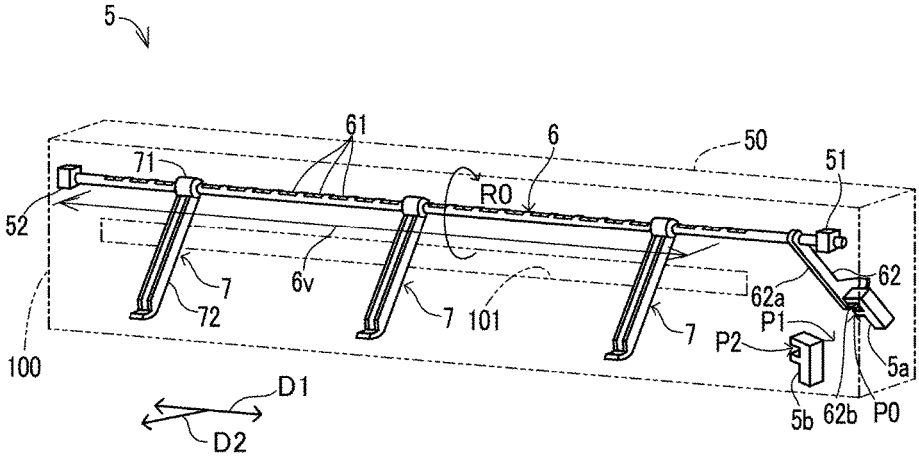
FIG. 3 is a perspective diagram of the stacked sheet detection device according to the first embodiment.

As shown in FIG. 2 and FIG. 3, the stacked sheet detection device 5 includes a support member 50, a shaft 6, a first rotor 7, a second rotor 62, and a fullness detection sensor 5*a*. It is noted that in FIG. 3, the support member 50 is drawn by an imaginary line in a simplified manner.

For example, the support member 50, the shaft 6, the first rotor 7, and the second rotor 62 may respectively be mold members made of synthetic resin. The support member 50 includes a pair of bearing portions 51 and 52 that are respectively fixed at constant positions.

The shaft 6 is rotatably supported by the pair of bearing portions 51 and 52 above the discharge port 101 so as to extend along the width direction D1. The first rotor 7 and the second rotor 62 are formed to extend from the shaft 6 and rotate around the shaft 6 in conjunction with the rotation of the shaft 6.

The first rotor 7 is provided in an effective region 6*v* of the shaft 6, wherein the effective region 6*v* corresponds to the width of the discharge port 101. In the present embodiment, the stacked sheet detection device 5 includes a plurality of first rotors 7.

The stacked sheet detection device 5 shown in FIG. 3 includes three first rotors 7. It is noted here that the stacked sheet detection device 5 may include one first rotor 7, two first rotors 7, or four or more first rotors 7.

The second rotor 62 is provided in a region of the shaft 6 outside the effective region 6*v*. The first rotors 7 and the second rotor 62 rotate around the shaft 6 in conjunction with the rotation of the shaft 6. For example, the first rotors 7 and the second rotor 62 may be integrally molded from synthetic resin.

When the first rotors 7 and the second rotor 62 are balanced around the shaft 6 with no external force applied to the first rotors 7, the second rotor 62 is positioned at a reference position P0.

As shown in FIG. 2, the sheets 9 stacked on the discharge tray 102 push up the first rotors 7 upon reaching a height exceeding a certain level. This allows the first rotors 7 to rotate in a predetermined rotation direction R0, the shaft 6 to rotate in the same rotation direction R0, and the second rotor 62 to rotate in the same rotation direction R0.

When the height of the sheets 9 exceeds the allowable level, the second rotor 62 rotates in the predetermined rotation direction R0 exceeding a predetermined allowable range. The allowable range is a range from the reference position P0 to an intermediate position P1 within which the second rotor 62 moves. The fullness detection sensor 5*a* is configured to detect that the second rotor 62 has rotated in the predetermined rotation direction R0 beyond the allowable range. That is, the fullness detection sensor 5*a* is configured to detect that the second rotor 62 has rotated in the predetermined rotation direction R0 beyond the predetermined intermediate position P1. It is noted that the intermediate position P1 is an example of the first detection position. In addition, the fullness detection sensor 5*a* is an example of the first detection sensor.

The second rotor 62 includes an arm portion 62*a* and a detected portion 62*b*. The arm portion 62*a* is formed to extend from the shaft 6 in a direction perpendicular to the width direction D1. The detected portion 62*b* is formed on a tip of the arm portion 62*a*. The second rotor 62 is configured to rotate integrally with the shaft 6.

The fullness detection sensor 5*a* shown in FIG. 2 and FIG. 3 is a PI (Photo Interrupter) sensor. The PI sensor is a transmission-type photosensor that includes a light emitting portion and a light receiving portion.

The fullness detection sensor 5*a* detects the detected portion 62*b* as far as the second rotor 62 rotates within the allowable range in the predetermined rotation direction R0 from the reference position P0 at which the second rotor 62 is balanced with the first rotors 7. That is, when the fullness detection sensor 5*a* fails to detect the detected portion 62*b*, the fullness detection sensor 5*a* detects that the second rotor 62 has rotated beyond the allowable range in the predetermined rotation direction R0.

It is noted that when the height of the sheets 9 stacked on the discharge tray 102 decreases to less than the allowable level, the first rotors 7 rotate in a direction opposite to the predetermined rotation direction R0 by their own weights, and the second rotor 62 returns to the reference position P0.

When the fullness of the sheets 9 is detected by the fullness detection sensor 5*a*, the control portion 8 prohibits the operation of the sheet supply portion 2 and the sheet conveying portion 3. Furthermore, the control portion 8 outputs a notification that urges to take out the sheets 9 from the discharge tray 102.

In a case where the stacked sheet detection device 5 includes a plurality of first rotors 7, the fullness detection sensor 5*a* can detect a rotation of the second rotor 62 if the sheets 9 stacked on the discharge tray 102 push up at least one of the plurality of first rotors 7. With this configuration, even if the orientation of the sheets 9 stacked on the discharge tray 102 is inclined with respect to the discharge direction D2, any of the plurality of first rotors 7 is pushed up by the sheets 9, making it possible for the fullness detection sensor 5*a* to detect the fullness of the sheets 9 stacked on the discharge tray 102.

In addition, there may be a case where a sheet 9 is discharged from the discharge port 101 in a curled state due to a heat received from the fixing device 49. In that case, a tip of the sheet 9 may abut on the discharge tray 102 or another sheet 9 on the discharge tray 102, resulting in a stack failure of the sheets 9 on the discharge tray 102.

However, if the curled sheet 9 is pressed from above on the way from the discharge port 101 to the discharge tray 102, an excessive floating of the sheet 9 is restricted, and occurrence of the stack failure is restricted.

In the stacked sheet detection device 5, the sheet 9 contacts the first rotors 7 on the way from the discharge port 101 to the discharge tray 102. At this time, the first rotors 7 are pushed up by the sheet 9, and the load of the first rotors 7 is applied to the sheet 9. With this configuration, the first rotors 7 restrict an excessive floating of the sheet 9 and prevents the stack failure of the sheets 9 on the discharge tray 102.

Meanwhile, there are various sheet properties, such as size, thickness, and material, with regard to the sheet 9 used in the image forming apparatus 10. In addition, there are various environmental conditions, such as temperature and humidity, with regard to the environment in which the image forming apparatus 10 is installed.

Positions of the first rotors 7 best suited to the detection of excessive stack of the sheets 9 and the prevention of stack failure of the sheets 9, may change depending on the use environment such as the sheet properties and the environmental conditions. However, in conventional apparatuses, it was not possible to adjust the positions of the first rotors 7 individually in each product of the apparatus.

On the other hand, the stacked sheet detection device 5 has a structure with which it is possible to easily adjust, depending on the use environment such as the sheet properties and the environmental conditions, the positions of the first rotors 7 that contact the sheet 9 discharged from the discharge port 101. In the following, the structure of the stacked sheet detection device 5 is described.

[Details of Stacked Sheet Detection Device 5]

Figure 4:
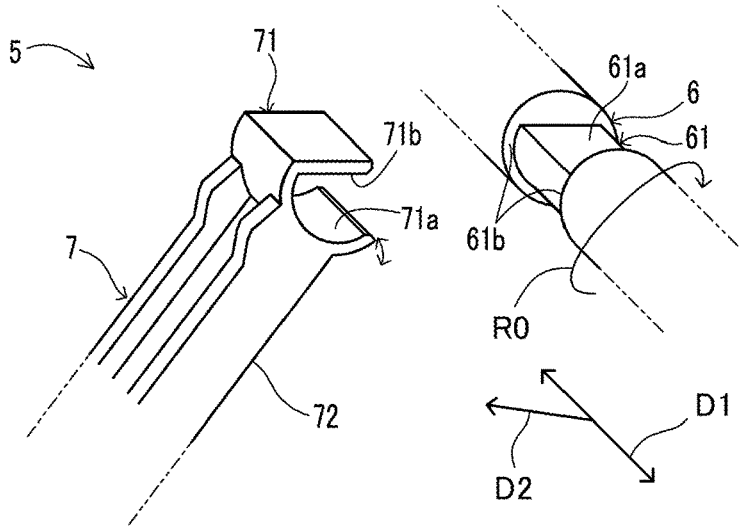
FIG. 4 is a perspective diagram of an attached portion and a fitting portion of the stacked sheet detection device according to the first embodiment.

As shown in FIG. 3 and FIG. 4, in the effective region 6*v* of the shaft 6 of the stacked sheet detection device 5, a plurality of attached portions 61 to which the first rotors are attached, are formed at intervals in alignment along the width direction D1.

As shown in FIG. 4, a pair of stepped portions 61*b* are formed between each of the attached portions 61 and portions of the shaft 6 at both sides of the attached portion 61 in the width direction D1. The pair of stepped portions 61*b* restrict the movement, in the width direction D1, of the first rotor 7 attached to the attached portion 61.

Each of the first rotors 7 includes a fitting portion 71 and an arm portion 72 that is formed to extend from the fitting portion 71. The fitting portion 71 is detachably attached to the attached portion 61 of the shaft 6. That is, the fitting portion 71 is detachable from the shaft 6 and can be selectively attached to any of the plurality of attached portions 61. In the present embodiment, the fitting portion 71 includes a recessed portion 71*a* configured to be fitted with the attached portion 61. That is, the recessed portion 71*a* of the fitting portion 71 can be fitted with the attached portion 61 from outside. It is noted that the recessed portion 71*a* is an example of the fitting recessed portion.

In the state where the fitting portions 71 are attached to the attached portions 61, the arm portions 72 of the first rotors 7 extend from the fitting portions 71 toward the discharge tray 102 (see FIG. 1 and FIG. 2). That is, the arm portions 72 project from the shaft 6 toward the discharge tray 102. With this configuration, the arm portions 72 of the first rotors 7 come into contact with a sheet 9 that is on the way from the discharge port 101 to the discharge tray 102. In addition, the arm portions 72 are configured to abut on the sheets 9 stacked on the discharge tray 102. The first rotors 7 can rotate integrally with the shaft 6.

Upon receiving an external force, the fitting portion 71 can elastically deform from a fitting shape to a non-fitting shape, wherein with the fitting shape, the fitting portion 71 is fitted with the attached portion 61, and with the non-fitting shape, the fitting portion 71 is disengaged from the attached portion 61. In the non-fitting shape, the opening of the recessed portion 71*a* is opened so as to have a width that is equal to or larger than the outer diameter of the attached portion 61.

In the present embodiment, when the arm portion 72 is pulled by an operation of a person with a force larger than a predetermined force, the fitting portion 71 elastically deforms from the fitting shape to the non-fitting shape.

In addition, when the opening portion of the recessed portion 71*a* is pressed against the attached portion 61 by an operation of a person holding the arm portion 72, with a force larger than a predetermined force, the recessed portion 71*a* is fitted with the attached portion 61, and the first rotor 7 is attached to the attached portion 61.

In the present embodiment, a part of the outer circumferential surface of the attached portion 61 is a flat surface 61*a*. In addition, a part of the inner surface of the recessed portion 71*a* of the fitting portion 71 is a flat surface 71*b* that comes into contact with the flat surface 61*a* of the attached portion 61.

The recessed portion 71*a* of the fitting portion 71 and the attached portion 61 are fitted with each other in the state where the flat surface 71*b* and the flat surface 61*a* are in contact with each other. In this state, the flat surface 71*b* and the flat surface 61*a* that are in contact with each other prevent the fitting portion 71 from sliding on the attached portions 61 in the circumferential direction of the shaft 6.

With the above-described configuration, when the arm portion 72 of the first rotor 7 is pushed up by the sheets 9 stacked on the discharge tray 102, the fitting portion 71 rotates in conjunction with the shaft 6 in the predetermined rotation direction R0. That is, when the arm portion 72 is pushed up by the sheets 9 stacked on the discharge tray 102, the first rotors 7 and the second rotor 62 rotate in conjunction with the shaft 6 in the predetermined rotation direction R0.

As shown in FIG. 3, the number of the attached portions 61 is greater than the number of the first rotors 7. Each of the first rotors 7 can be reattached from one to another of the plurality of attached portions 61.

With the adoption of the stacked sheet detection device 5, it is possible to easily adjust the positions of the first rotors 7 that come into contact with a sheet 9 discharged from the discharge port 101, in correspondence with the use environment such as the sheet properties of the used sheet 9 and the environmental conditions.

Figure 6:
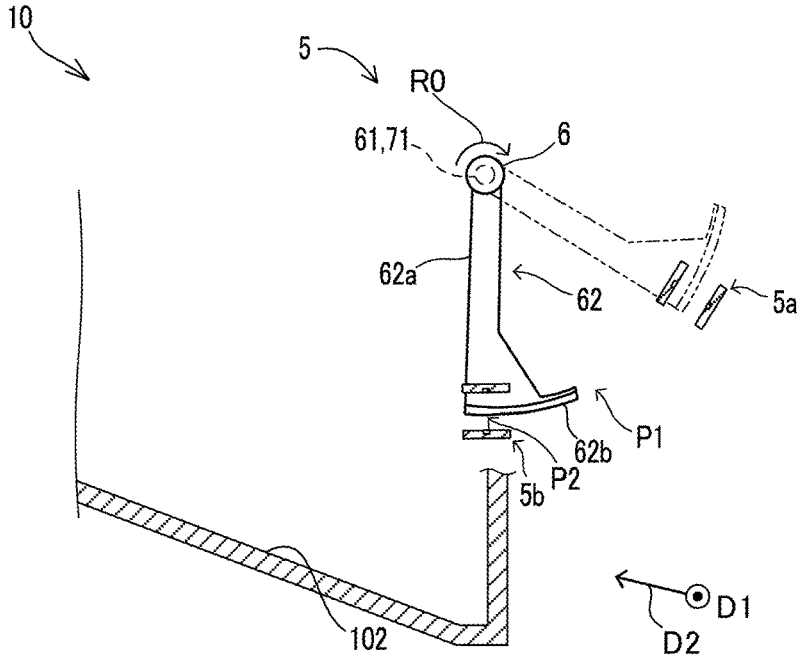
FIG. 6 is a side view of the stacked sheet detection device in a state where all first rotors have been removed.

In addition, as shown in FIG. 2, FIG. 3 and FIG. 6, the stacked sheet detection device 5 further includes an out-of-range detection sensor 5*b*.

As shown in FIG. 6, the out-of-range detection sensor 5*b* is configured to detect that the second rotor 62 has rotated in the predetermined rotation direction R0 to a predetermined out-of-range position P2 by exceeding the intermediate position P1. In the present embodiment, as is the case with the fullness detection sensor 5*a*, the out-of-range detection sensor 5*b* is a PI sensor.

In a case where one or more first rotors 7 are attached to the shaft 6, a torque that acts on the shaft 6 from the first rotors 7 in a direction opposite to the predetermined rotation direction R0, and a torque that acts on the shaft 6 from the second rotor 62 in the predetermined rotation direction R0, are balanced with each other, and thus the second rotor 62 does not reach the out-of-range position P2.

On the other hand, when all the first rotors 7 are removed from the shaft 6, the second rotor 62 rotates to the out-of-range position P2 by its own weight, and stops at the out-of-range position P2. Upon detecting the detected portion 62*b*, the out-of-range detection sensor 5*b* detects that the second rotor 62 has rotated to the out-of-range position P2 exceeding the allowable range.

That is, the out-of-range detection sensor 5*b* is configured to detect that all the first rotors 7 have been removed from the shaft 6.

For example, a small-scale post-processing unit as an option unit may be attached above the discharge tray 102 of the image forming apparatus 10. The post-processing unit takes in a sheet 9 with an image formed thereon that is discharged from the discharge port 101, and performs a post-process such as a punching process or a stapling process on the sheet 9.

In a case where the post-processing unit is attached to the image forming apparatus 10, the function of the stacked sheet detection device 5 to detect the fullness of the sheets 9 is not necessary. In addition, in order to place the post-processing unit close to the discharge port 101, the first rotors 7 are preferably not present. With the adoption of the stacked sheet detection device 5, it is possible to remove all the first rotors 7 from the shaft 6.

In general, not all the first rotors 7 are removed from the shaft 6, except for a case where the post-processing unit is attached above the discharge tray 102. As a result, the out-of-range detection sensor 5*b* can be used as a sensor that indirectly detects that the post-processing unit is attached above the discharge tray 102.

In addition, there may be a case where the image forming apparatus 10 is used, by the mistake of the user, in a state where all the first rotors 7 have been removed from the shaft 6. As a result, in a case where the out-of-range detection sensor 5*b* detects that all the first rotors 7 have been removed from the shaft 6, the control portion 8 may output a notification that urges to attach the first rotors 7 or the post-processing unit to the shaft 6.

Second Embodiment: Stacked Sheet Detection Device 5X

Next, a stacked sheet detection device 5X according to a second embodiment applied to the image forming apparatus 10 is described with reference to FIG. 7 to FIG. 10. In the following, differences between the stacked sheet detection device 5X and the stacked sheet detection device 5 are described.

Compared to the stacked sheet detection device 5, the stacked sheet detection device 5X includes attached portions 61X and fitting portions 71X in stead of the attached portions 61 and the fitting portions 71, and each of the first rotors 7 additionally includes a lever portion 73.

In the stacked sheet detection device 5X, the lever portion 73 of the first rotor 7 is formed to extend from the fitting portion 71. Upon being operated, the lever portion 73 elastically deforms the fitting portion 71 from the fitting shape with which the fitting portion 71 is fitted with the attached portion 61X, to the non-fitting shape.

Figure 8:
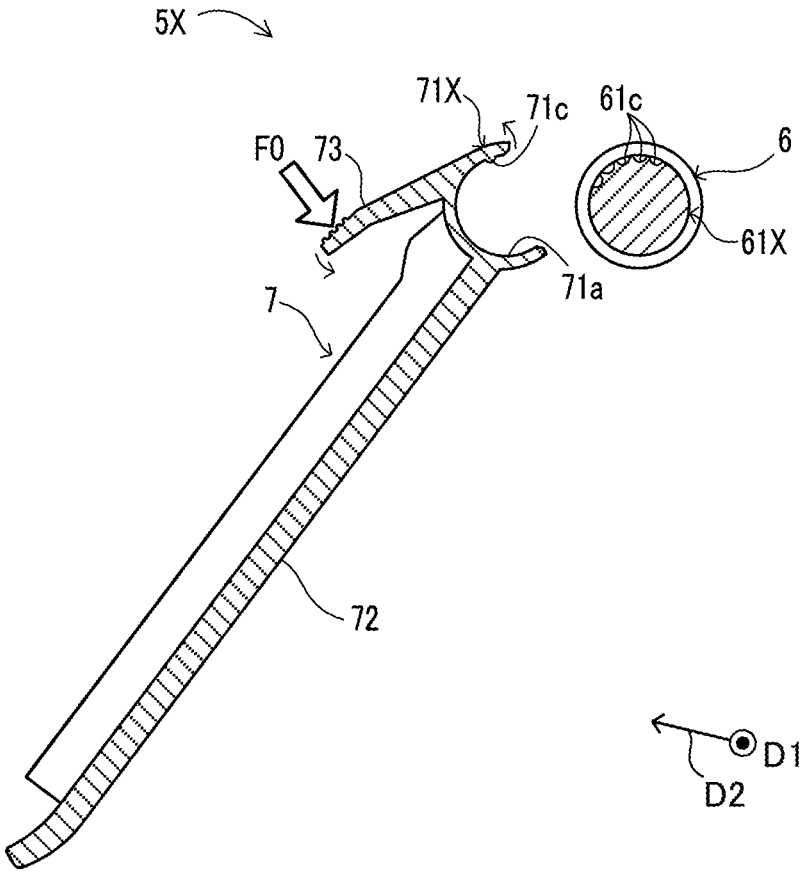
FIG. 8 is an exploded cross-sectional diagram of the stacked sheet detection device according to the second embodiment.
Figure 9:
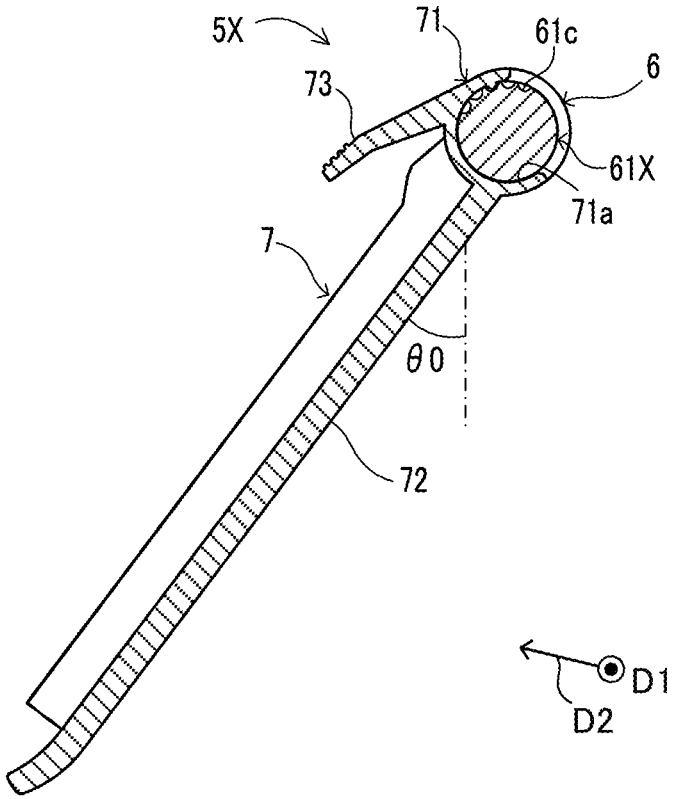
FIG. 9 is a cross-sectional diagram of the stacked sheet detection device according to the second embodiment.
Figure 10:
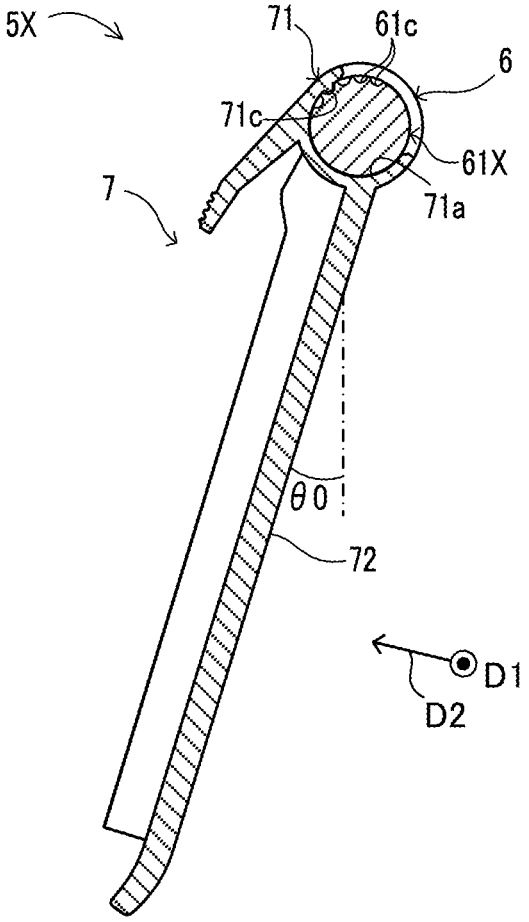
FIG. 10 is a cross-sectional diagram of the stacked sheet detection device in a state where an attachment orientation of the first rotor has been changed.

That is, an external force F0 applied to the lever portion 73 is transmitted from the lever portion 73 to the fitting portion 71 as a force that elastically deforms the fitting portion 71 to the non-fitting shape (see FIG. 8). With the adoption of the first rotor 7 including the lever portion 73, the first rotor 7 can be attached to and detached from the attached portion 61X more easily.

In addition, it is possible to attach the fitting portion 71X to the attached portion 61X in an attachment orientation in the circumferential direction of the shaft 6 that is selected from a predetermined plurality of orientation candidates. This makes it possible to select an angle θ0 that is formed by the arm portion 72 of the first rotor 7 with respect to the vertical direction, from among the plurality of orientation candidates (see FIG. 9 and FIG. 10).

More specifically, each of the attached portions 61X includes a plurality of engaged portions 61*c* that are recessed portions formed at intervals in the circumferential direction. On the other hand, the fitting portion 71X includes an engaging portion 71*c* that is a projection portion selectively engaged with one of the plurality of engaged portions 61*c*. Upon being engaged with one of the plurality of engaged portions 61*c*, the engaging portion 71*c* restricts the movement of the fitting portion 71X on the shaft 6 in the circumferential direction.

In the stacked sheet detection device 5X, the outline shape of the attached portion 61X is a shape in which the plurality of engaged portions 61*c* are formed on the circumferential surface. In addition, the inner shape of the recessed portion 71*a* of the fitting portion 71X is a shape in which the engaging portion 71*c*, as a projection, is formed on the circumferential surface.

It is noted that the plurality of engaged portions 61*c* may be projection portions, and the engaging portion 71*c* may be a recessed portion that can be engaged with one of the engaged portions 61*c*.

Figure 5:
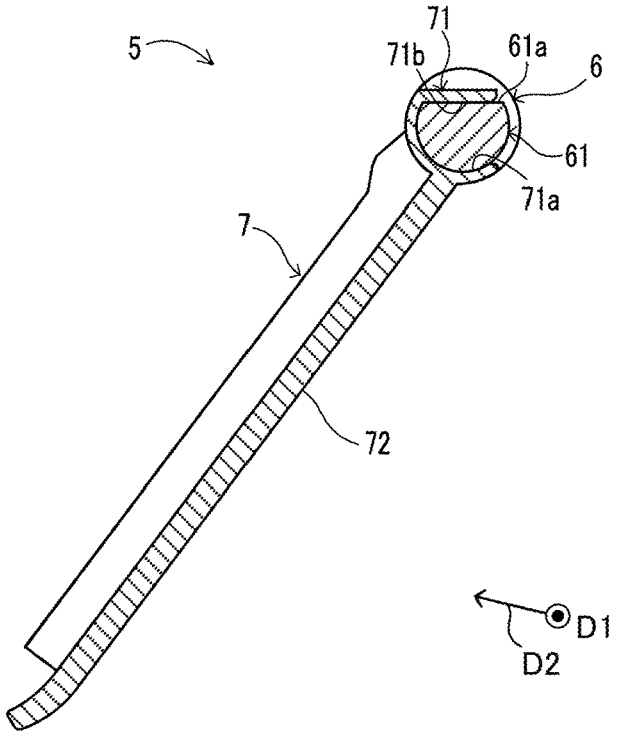
FIG. 5 is a cross-sectional diagram of the stacked sheet detection device according to the first embodiment.

In place of the flat surface 61*a* of the attached portions 61 and the flat surface 71*b* of the fitting portion 71 shown in FIG. 4 and FIG. 5, the engaged portion 61*c* of the attached portion 61X and the engaging portion 71*c* of the fitting portion 71X restrict the movement of the fitting portion 71X on the shaft 6 in the circumferential direction.

It is noted that when the fitting portion 71X is deformed from the fitting shape to the non-fitting shape, the engagement between the engaged portion 61*c* and the engaging portion 71*c* is released.

With the adoption of the stacked sheet detection device 5X, the position of the first rotor 7 in the width direction D1 and the angle of the arm portion 72 of the first rotor 7 can be easily adjusted based on the sheet properties and the environmental conditions.

Figure 7:
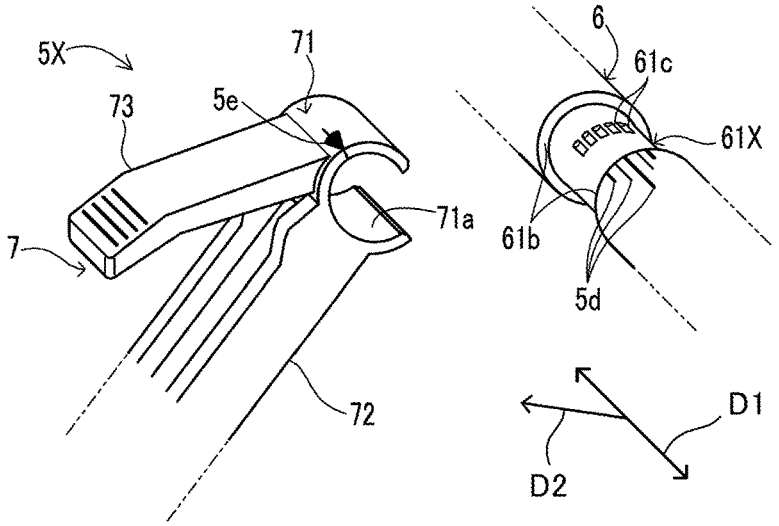
FIG. 7 is a perspective diagram of an attached portion and a fitting portion of a stacked sheet detection device according to a second embodiment.

In addition, as shown in FIG. 7, graduations, namely a plurality of graduation marks 5*d*, are formed at positions on the circumferential surface of the shaft 6 in correspondence with the plurality of attached portions 61X. The plurality of graduation marks 5*d* indicate attachment orientations of the fitting portion 71X in the circumferential direction of the shaft 6. In addition, an indicating portion 5*e* is formed on the surface of the fitting portion 71 of the first rotor 7, wherein the indicating portion 5*e* indicates one of the plurality of graduation marks 5*d*. The plurality of graduation marks 5*d* and the indicating portion 5*e*, for example, are projecting or recessed than the other portions around them.

More specifically, in the vicinity of the attached portion 61X of the shaft 6, the plurality of graduation marks 5*d* are formed in alignment in the circumferential direction in correspondence with the plurality of engaged portions 61*c*. The plurality of graduation marks 5*d* represent a plurality of candidates for the attachment angle of the first rotor 7 in the circumferential direction with respect to the shaft 6. In addition, the indicating portion 5*e* that indicates any of the plurality of graduation marks is formed on the fitting portion 71 of the first rotor 7. The indicating portion 5*e* indicates one of the plurality of graduation marks 5*d* that corresponds to an actual attachment angle of the first rotor 7.

With the above-described configuration where the plurality of graduation marks 5*d* and the indicating portion 5*e* are formed on the shaft 6 and the fitting portion 71, the attachment orientation of the first rotor 7 with respect to the shaft 6 can be easily grasped. It is noted that the plurality of graduation marks 5*d* may be formed on the fitting portion 71, and the indicating portion 5*e* may be formed at a plurality of locations of the shaft 6 that correspond to the plurality of attached portions 61X.

Third Embodiment: Stacked Sheet Detection Device 5Y

Figure 11:
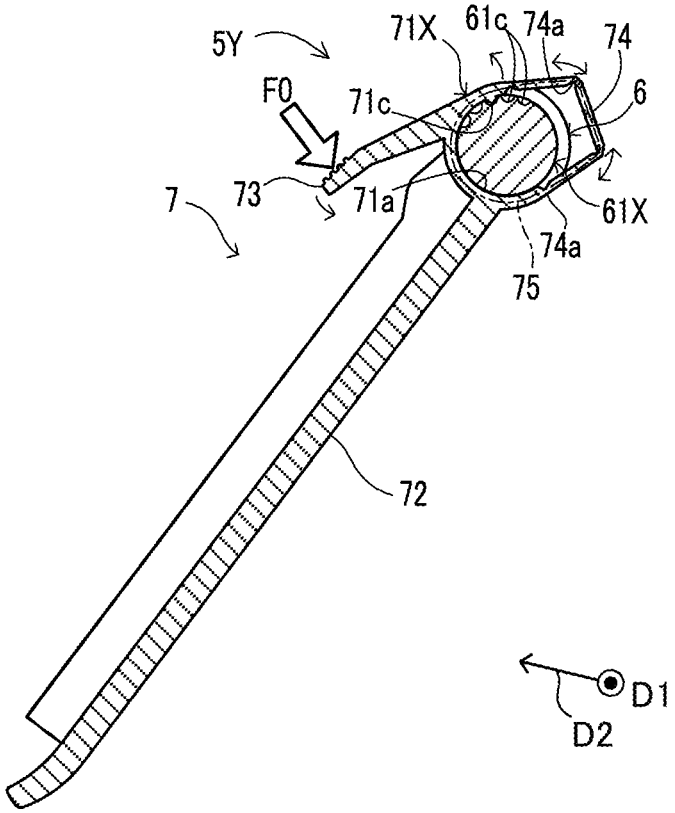
FIG. 11 is a cross-sectional diagram of a stacked sheet detection device according to a third embodiment.

Next, a stacked sheet detection device 5Y according to a third embodiment applied to the image forming apparatus 10 is described with reference to FIG. 11. In the following, differences between the stacked sheet detection device 5Y and the stacked sheet detection device 5X are described.

The stacked sheet detection device 5Y has a structure where a flexible portion 74 has been added to the stacked sheet detection device 5X shown in FIG. 7 to FIG. 10.

In the stacked sheet detection device 5Y, the first rotor 7 further includes the flexible portion 74. The flexible portion 74 continues from the fitting portion 71, and together with the fitting portion 71, forms a ring 75 that surrounds the circumference of the shaft 6 (see the one-dot chain line in FIG. 11). As shown in FIG. 11, the flexible portion 74 closes the opening of the recessed portion 71*a* of the fitting portion 71.

The flexible portion 74 is configured to deform in response to a deformation of the fitting portion 71X from the fitting shape to the non-fitting shape. In the example shown in FIG. 11, the flexible portion 74 includes a plurality of thin portions 74 that are smaller in thickness than the other portions. This enables the flexible portion 74 to deform in response to the deformation of the fitting portion 71X.

The flexible portion 74 prevents the first rotor 7 from being separated from the shaft 6, while allowing the fitting portion 71X to deform.

In the stacked sheet detection device 5Y, each of the first rotors 7 can be reattached from one to another of the plurality of attached portions 61 in a state where the shaft 6 passes through the ring 75 formed by the fitting portion 71X and the flexible portion 74. In other words, it is possible to reattach each of the first rotors 7 from one to another of the plurality of attached portions 61 by allowing the fitting portion 71X to slide on the shaft 6 in the width direction D1. In this way, the fitting portion 71X can be selectively attached to any of the plurality of attached portions 61.

In the stacked sheet detection device 5Y, the fitting portions 71X can be disengaged from the attached portions 61X, but the first rotors 7 cannot be removed from the shaft 6. This prevents the loss of the first rotors 7.

Application Examples

In the stacked sheet detection devices 5, 5X, and 5Y, the fullness detection sensor 5*a* and the out-of-range detection sensor 5*b* each may be another type of sensor such as a limit switch or a reflection-type photosensor. It is noted that the limit switch is a contact type sensor.

In addition, in the stacked sheet detection devices 5X and 5Y, the engaged portions 61*c* and the engaging portion 71*c* play a role of restricting the first rotors 7 attached to the attached portions 61X from moving in the width direction D1. As a result, in the stacked sheet detection devices 5X and 5Y, the shaft 6 may not include the stepped portions 61*b* for each of the attached portions 61.

It is noted that the stacked sheet detection device and the image forming apparatus of the present disclosure may be configured by freely combining, within the scope of claims, the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A stacked sheet detection device which detects sheets discharged from a discharge port of a sheet conveyance path and stacked on a discharge tray exceeding an allowable level, the stacked sheet detection device comprising:

a shaft rotatably supported above the discharge port so as to extend in parallel with a width direction perpendicular to a discharge direction of the sheets;

at least one first rotor attached to the shaft so as to project toward the discharge tray, and configured to rotate in conjunction with the shaft in a predetermined rotation direction when pushed up by the sheets stacked on the discharge tray;

a second rotor projecting from the shaft radially and configured to rotate integrally with the shaft; and a first detection sensor configured to detect that the second rotor rotates in the predetermined rotation direction beyond a predetermined first detection position, wherein the shaft includes:

a plurality of attached portions formed in alignment along the width direction and to which the first rotor is attachable, the first rotor includes:

a fitting portion fitted with one of the attached portions; and an arm portion formed to extend from the fitting portion toward the discharge tray and configured to abut on the sheets stacked on the discharge tray, and the first rotor is selectively attachable to any one of the plurality of attached portions.

2. The stacked sheet detection device according to claim 1, wherein the fitting portion can be elastically deformed from a fitting shape to a non-fitting shape, wherein with the fitting shape, the fitting portion is fitted with one of the attached portions, and with the non-fitting shape, the fitting portion is disengaged from the attached portions.

3. The stacked sheet detection device according to claim 2, wherein the first rotor further includes:

a lever portion formed to extend from the fitting portion and configured to elastically deform the fitting portion to the non-fitting shape.

4. The stacked sheet detection device according to claim 1, wherein the fitting portion is attachable to any one of the attached portions at an angle that is formed by the arm portion.

5. The stacked sheet detection device according to claim 4, wherein each of the attached portions includes a plurality of engaged portions formed at intervals in a circumferential direction of the shaft, and the fitting portion includes:

a fitting recessed portion configured to be fitted with any one of the attached portions from outside; and an engaging portion formed on an inner circumferential surface of the fitting recessed portion, and configured to restrict movement of the fitting portion with respect to the any one of the attached portions in the circumferential direction by being selectively engaged with one of the plurality of engaged portions.

6. The stacked sheet detection device according to claim 4, wherein a plurality of graduation marks are formed on a circumferential surface of the shaft, and an indicating portion is formed on a surface of the fitting portion, the graduation marks representing a plurality of candidates for an attachment angle of the first rotor, in a circumferential direction of the shaft, the indicating portion indicating any one of the plurality of graduation marks that corresponds to an actual attachment angle of the first rotor.

7. The stacked sheet detection device according to claim 1, wherein the fitting portion is detachable from the one of the attached portions of the shaft.

8. The stacked sheet detection device according to claim 7, further comprising:

a second detection sensor configured to detect that the second rotor rotates in the predetermined rotation direction to a predetermined second detection position exceeding the first detection position, wherein when the first rotor is not attached to the shaft, the second rotor stops at the second detection position by its own weight.

9. The stacked sheet detection device according to claim 1, wherein the fitting portion includes a fitting recessed portion configured to be fitted with one of the attached portions from outside, each of the first rotors further includes a flexible portion that continues from the fitting portion, closes an opening of the fitting recessed portion, and is configured to deform in response to a deformation of the fitting portion to a non-fitting shape with which the fitting portion is disengaged from the attached portions, and it is possible to reattach each of the first rotors from one to another of the plurality of attached portions by sliding the fitting portion on the shaft in the width direction.

10. An image forming apparatus comprising:

an image forming portion configured to form an image on a sheet conveyed along a sheet conveyance path;

a sheet discharge portion configured to discharge the sheet with the image formed thereon from a discharge port of the sheet conveyance path onto a discharge tray; and the stacked-sheet detection device according to claim 1.

* * * * *